US007413520B1

(12) United States Patent
Hocknell et al.

(10) Patent No.: US 7,413,520 B1
(45) **Date of Patent: *Aug. 19, 2008**

(54) GOLF CLUB HEAD WITH HIGH MOMENT OF INERTIA

(75) Inventors: Alan Hocknell, Carlsbad, CA (US); Patrick Dawson, San Diego, CA (US); Brandon T. Vincent, San Clemente, CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/026,024

(22) Filed: Feb. 5, 2008

Related U.S. Application Data

(60) Provisional application No. 60/893,932, filed on Mar. 9, 2007.

(51) Int. Cl.
*A63B 53/04* (2006.01)

(52) U.S. Cl. ..... 473/345; 473/349

(58) Field of Classification Search ..... None
See application file for complete search history.

(56) References Cited

U.S. PATENT DOCUMENTS

| | | | | |
|---|---|---|---|---|
| 5,397,127 | A * | 3/1995 | Kawada et al. | 473/324 |
| 5,669,827 | A * | 9/1997 | Nagamoto | 473/345 |
| 5,743,812 | A * | 4/1998 | Card | 473/327 |
| 5,746,666 | A * | 5/1998 | Lovett | 473/328 |
| 5,935,020 | A * | 8/1999 | Stites et al. | 473/345 |
| 6,048,278 | A * | 4/2000 | Meyer et al. | 473/345 |
| 6,074,310 | A * | 6/2000 | Ota | 473/345 |
| 6,402,639 | B1 * | 6/2002 | Iwata et al. | 473/330 |
| 6,471,604 | B2 * | 10/2002 | Hocknell et al. | 473/334 |
| 6,524,194 | B2 * | 2/2003 | McCabe | 473/305 |
| 6,582,323 | B2 | 6/2003 | Soracco et al. | |
| 6,602,149 | B1 | 8/2003 | Jacobson | |
| 6,620,055 | B2 * | 9/2003 | Saso | 473/324 |
| 6,679,782 | B2 * | 1/2004 | Tang et al. | 473/242 |
| 6,679,786 | B2 * | 1/2004 | McCabe | 473/305 |
| 6,793,588 | B2 * | 9/2004 | Tang et al. | 473/242 |
| 6,860,824 | B2 | 3/2005 | Evans | |
| 6,875,129 | B2 * | 4/2005 | Erickson et al. | 473/345 |
| 6,878,073 | B2 * | 4/2005 | Takeda | 473/346 |
| 6,905,420 | B2 * | 6/2005 | Tang et al. | 473/242 |
| 7,014,571 | B2 * | 3/2006 | Deshmukh | 473/342 |
| 7,070,512 | B2 * | 7/2006 | Nishio | 473/319 |

(Continued)

FOREIGN PATENT DOCUMENTS

| | | | |
|---|---|---|---|
| JP | 01022265 A | * | 1/1989 |

(Continued)

*Primary Examiner*—Gene Kim
*Assistant Examiner*—Alvin A Hunter
(74) *Attorney, Agent, or Firm*—Michael A. Catania; Elaine H. Lo

(57) ABSTRACT

A golf club head having a high moment of inertia is disclosed herein. The golf club head preferably has a volume ranging from 450 cubic centimeters to 475 cubic centimeters, a mass ranging from 180 grams to 225 grams, and a length ranging from 4.0 inches to 5.0 inches. The golf club head preferably has a moment of inertia, Iyy, about the center of gravity of the golf club head greater than 4000 grams-centimeters squared. Preferably, the golf club includes a metal face component, a non-metal aft-body and a weight member attached to an inlaid portion of the non-metal aft-body.

1 Claim, 7 Drawing Sheets

U.S. PATENT DOCUMENTS

| | | | | |
|---|---|---|---|---|
| 7,082,665 | B2 * | 8/2006 | Deshmukh et al. | 29/527.6 |
| 7,101,289 | B2 * | 9/2006 | Gibbs et al. | 473/329 |
| 7,112,148 | B2 * | 9/2006 | Deshmukh | 473/342 |
| 7,156,750 | B2 * | 1/2007 | Nishitani et al. | 473/329 |
| 7,163,468 | B2 * | 1/2007 | Gibbs et al. | 473/329 |
| 7,166,038 | B2 * | 1/2007 | Williams et al. | 473/329 |
| 7,169,060 | B2 * | 1/2007 | Stevens et al. | 473/329 |
| 7,258,626 | B2 * | 8/2007 | Gibbs et al. | 473/329 |
| 7,278,927 | B2 * | 10/2007 | Gibbs et al. | 473/329 |
| 7,291,075 | B2 * | 11/2007 | Williams et al. | 473/329 |
| 7,306,527 | B2 * | 12/2007 | Williams et al. | 473/329 |
| 7,311,613 | B2 * | 12/2007 | Stevens et al. | 473/329 |
| 7,318,782 | B2 * | 1/2008 | Imamoto et al. | 473/345 |
| 7,344,452 | B2 * | 3/2008 | Imamoto et al. | 473/345 |
| 7,347,795 | B2 * | 3/2008 | Yamagishi et al. | 473/345 |
| 7,347,796 | B2 * | 3/2008 | Takeda | 473/345 |
| 2005/0026719 | A1 * | 2/2005 | Yang | 473/342 |
| 2005/0278931 | A1 * | 12/2005 | Deshmukh et al. | 29/469 |

FOREIGN PATENT DOCUMENTS

| | | | | |
|---|---|---|---|---|
| JP | 01166782 | A | * | 6/1989 |
| JP | 08224328 | A | * | 9/1996 |
| JP | 09215786 | A | * | 8/1997 |
| JP | 10015118 | A | * | 1/1998 |
| JP | 11178955 | A | * | 7/1999 |
| JP | 2004261451 | A | * | 9/2004 |
| JP | 2005000576 | A | * | 1/2005 |
| JP | 2005152073 | A | * | 6/2005 |
| JP | 2006000461 | A | * | 1/2006 |
| WO | WO 9836802 | A2 | * | 8/1998 |

* cited by examiner

Heel Toe Cuts

| | Weight [g] | | | | | Distances [in] | | | |
|---|---|---|---|---|---|---|---|---|---|
| **Location** | **Invention** | **X460** | **FT-5** | **FT-i** | **Cut** | **Invention** | **X460** | **FT-5** | **FT-i** |
| 0.5 | 81.5547 | 65.2013 | 60.2663 | 61.656 | 42a | 5.104 | 4.35507 | 4.309 | 4.01 |
| 1 | 42.0052 | 45.3717 | 27.9451 | 35.6399 | 42b | 5.328 | 4.74539 | 4.654 | 4.639 |
| 1.5 | 14.6823 | 20.1111 | 18.3764 | 17.3447 | 42c | 5.141 | 4.7923 | 4.742 | 4.446 |
| 2 | 5.5844 | 14.7694 | 13.4285 | 7.1579 | 42d | 4.807 | 4.6897 | 4.653 | 4.461 |
| 2.5 | 5.2043 | 14.0436 | 16.3459 | 7.1263 | 42e | 4.426 | 4.4173 | 4.403 | 4.398 |
| 3 | 4.6655 | 13.4459 | 17.7714 | 8.4151 | 42f | 3.999 | 3.9379 | 3.973 | 4.252 |
| 3.5 | 4.1276 | 12.1125 | 13.8236 | 18.2511 | 42g | 3.508 | 3.169 | 3.303 | 4.012 |
| 4 | 3.93 | 10.8756 | 19.0489 | 30.7201 | 42h | 2.911 | 1.79 | 2.2 | 3.464 |
| 4.5 | 14.9687 | 3.9483 | 10.4414 | 11.4727 | 42i | 2.103 | 0 | 0 | 0 |
| 5.0 | 23.8583 | 0 | 0 | 0 | | | | | |

*FIG. 6*

GOLF CLUB HEAD WITH HIGH MOMENT OF INERTIA

CROSS REFERENCES TO RELATED APPLICATIONS

The present application claims priority to U.S. Provisional Patent Application No. 60/893,932 filed on Mar. 9, 2007.

STATEMENT REGARDING FEDERALLY SPONSORED RESEARCH OR DEVELOPMENT

Not Applicable

BACKGROUND OF THE INVENTION

1. Field of the Invention

The present invention relates to a golf club head with high moments of inertia. More specifically, the present invention relates to a golf club head with a high moment of inertia through a center of gravity of the golf club head along a sole to crown axis (Izz) and a high moment of inertia through a center of gravity of the golf club head along a heel to toe axis (Iyy).

2. Description of the Related Art

Golf club companies have been increasing inertia properties of drivers to increase their performance particularly off center ball speed. The conventional shape of a driver limits the inertial values for a given head weight that can be attained within the dimension rules set by the USGA. Designs such as the FT-i have used non traditional shapes to increase inertia but the volume rule limits the potential efficiency of the location of discretionary weight placement. Designs that make use of light sections or light material to increase the amount of discretionary mass usually do not or can not (because of shape inefficiencies) place the discretionary mass in locations that provide the highest inertial benefit. Callaway Golf's FUSION® technology allows weight to be placed for high inertia by reducing the amount of weight tied up in the body of the club where inertia value is low.

The Rules of Golf, established and interpreted by the United States Golf Association ("USGA") and The Royal and Ancient Golf Club of Saint Andrews, set forth certain requirements for a golf club head. The requirements for a golf club head are found in Rule 4 and Appendix II. A complete description of the Rules of Golf are available on the USGA web page at www.usga.org. One such limitation is the volume of the golf club head.

Existing large volume driver heads (>400 cc) composed of conventional materials (titanium, steel) and conventional manufacturing methods (casting, forging, MIM, machining, etc.) are limited in the amount of discretionary material available for increasing the moments of inertia of the golf club head. Conventional golf club head shapes also limit the moments of inertia possible for any given volume golf club head.

BRIEF SUMMARY OF THE INVENTION

One aspect of the present invention is a golf club head. The golf club head includes a face component, an aft-body and a weight member. The face component includes a striking plate portion and a return portion extending rearward from the striking plate portion. The face component is composed of a metal material and has a mass ranging from 100 grams to 150 grams. The aft-body is attached to the return portion of the face component. The aft-body is composed of a non-metal material. The aft-body has a mass ranging from 20 grams to 60 grams. The aft-body has a rearward inlaid portion. The weight member is attached to the rearward inlaid portion of the aft-body. The weight member is composed of material having a density greater than the density of the metal material of the face component. The weight member has a mass ranging from 20 grams to 60 grams. The golf club head has a volume ranging from 450 cubic centimeters to 475 cubic centimeters. The golf club head has a mass ranging from 180 grams to 225 grams.

The golf club head preferably has length ranging from 4.0 inches to 5.0 inches as measured from the forwardmost extent of the front wall to a rearward most extent of the rear wall. The golf club head preferably has a moment of inertia, Iyy, about the center of gravity of the golf club head greater than 4000 grams-centimeters squared, and more preferably greater than 4500 grams-centimeters squared. The golf club head preferably has a moment of inertia, Izz, about the center of gravity of the golf club head greater than 5000 grams-centimeters squared, and more preferably greater than 6000 grams-centimeters squared. The golf club head is partitioned by a plurality of vertical planes into a first section, a second section and a third section. The first section extends from the front wall to a first vertical plane located 1.0 inch rearward of the front wall of the golf club head. The third section extends from a second vertical plane located 4.5 inches rearward of the front wall of the golf club head to the rear wall. The second section is positioned between the first section and the third section. The first section has a height from sole to crown of at least 2.5 inches. The third section has a height from sole to crown of less than 1.0 inch. The second section has a height from sole to crown that is less than the height of the first section and greater than the height of the third section.

Another aspect of the present invention is a golf club head having a moment of inertia, Izz, about the center of gravity of the golf club head of approximately 6000 grams-centimeters squared with a center of gravity position that is optimal for maximum ball distance when striking a golf ball. The golf club head alternatively has a moment of inertia, Iyy, about the center of gravity of the golf club head ranging from 2000 grams-centimeters squared to 4000 grams-centimeters squared.

Another objective of the present invention is a large face area with high moments of inertia for improved off center ball speeds.

Yet another aspect of the present invention is a golf club head having a titanium face component, a composite body, and a Tungsten weight. The face component is designed with a maximum width of five inches which allows the body to be designed such that the tungsten back weight can be placed as far from the face as possible, and preferably five inches from the face. The shape of the body is narrow when viewed from the top to decrease the volume of the club head while allowing the length of the body to be a maximum dimension. This allows the tungsten weight to be placed all the way in the back of the body so that it will generate the maximum amount of inertia per gram of discretionary mass. As little mass as possible is placed on the sides of the body to maximize the contribution of each gram toward the moments of inertia, Iyy and Izz.

Yet another aspect of the present invention is a large face area where in the face has a width of five inches and a height of two point eight (2.8) inches, for golf club head less than 470 cc.

Yet another aspect of the present invention is a golf club head with a moment of inertia, Izz about the center of gravity greater than 5000 g-cm$^2$.

Yet another aspect of the present invention is a golf club head with a moment of inertia, Iyy about the center of gravity greater than 4000 g-cm$^2$.

Yet another aspect of the present invention is a golf club head with a large ratio of Izz/Mass.

Yet another aspect of the present invention is a golf club head with a large ratio of Iyy/Mass.

Yet another aspect of the present invention is a golf club head with a large ratio of Izz/Mass.

Yet another aspect of the present invention is a golf club head with a large ratio of Iyy/Mass.

Yet another aspect of the present invention is a golf club head with a large ratio of (Izz+Iyy)/Ixx.

Yet another aspect of the present invention is a golf club head with a large ratio of (Izz+Iyy)/Mass.

Yet another aspect of the present invention is a golf club head with a large ratio of Izz+Iyy) volume.

Yet another aspect of the present invention is a golf club head with greater than 15% of the mass located greater than four inches from leading edge of face.

Yet another aspect of the present invention is a golf club head with greater than thirty grams located further than four inches from leading edge of face.

Having briefly described the present invention, the above and further objects, features and advantages thereof will be recognized by those skilled in the pertinent art from the following detailed description of the invention when taken in conjunction with the accompanying drawings.

BRIEF DESCRIPTION OF THE SEVERAL VIEWS OF THE DRAWINGS

FIG. 6 is a table for weight and distances related to the representation of a golf club head of FIG. 5 with a comparison to commercially available golf club heads.

DETAILED DESCRIPTION OF THE INVENTION

Figure 1:
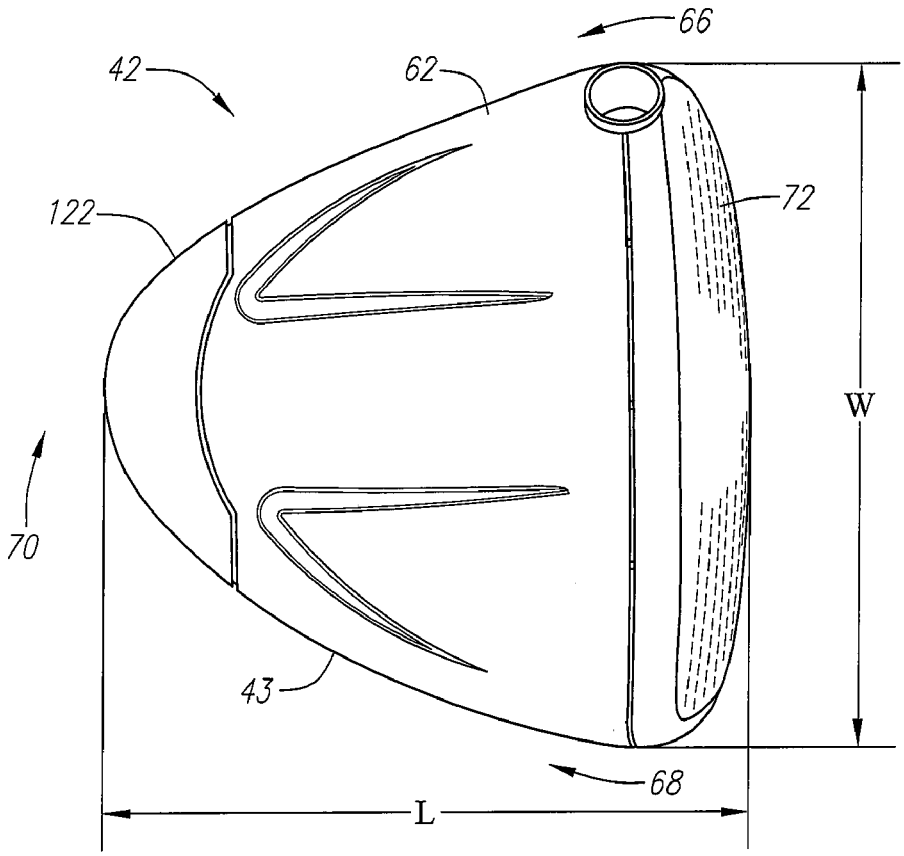
FIG. 1 is a top plan view of a golf club head of the present invention.
Figure 2:
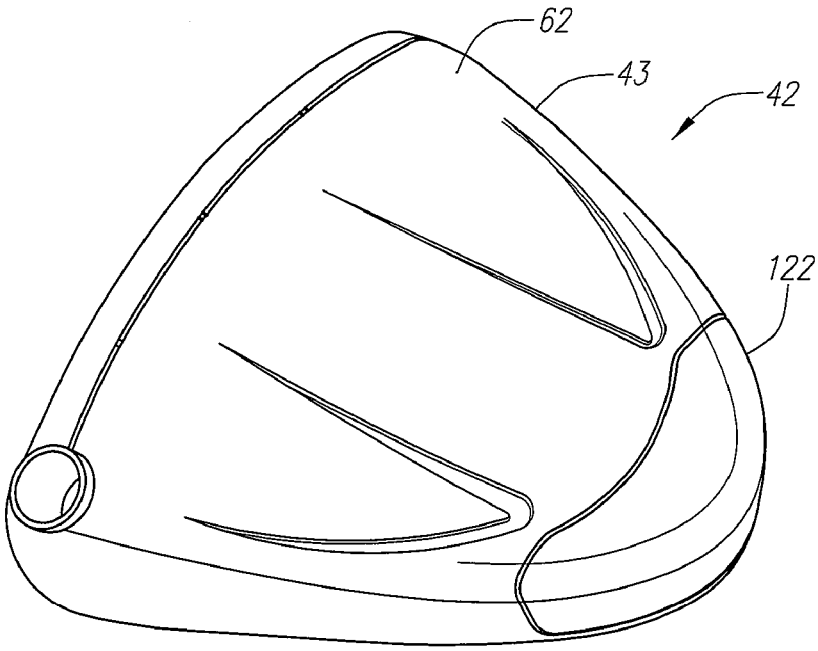
FIG. 2 is a top perspective view of the golf club head of FIG. 1.
Figure 3:
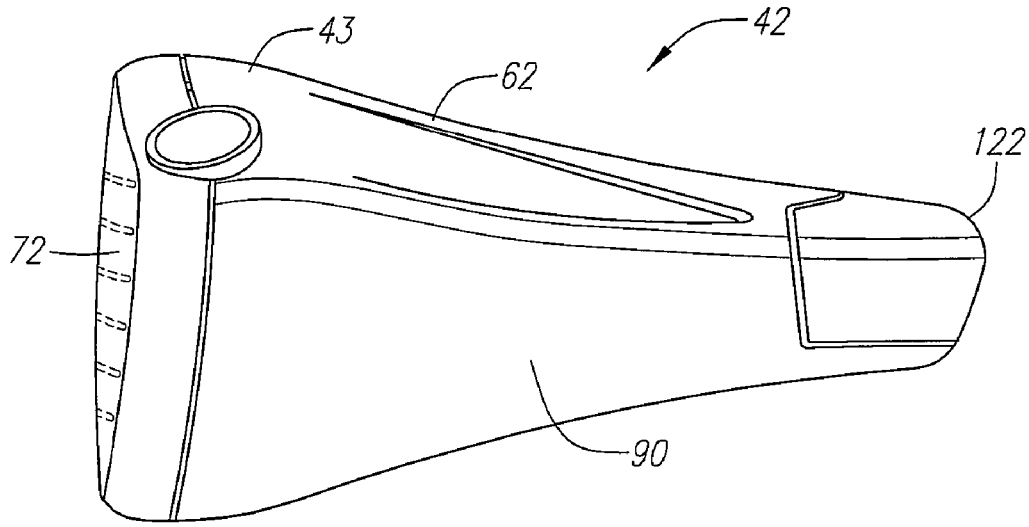
FIG. 3 is a side view of the golf club head of FIG. 1.
Figure 4:
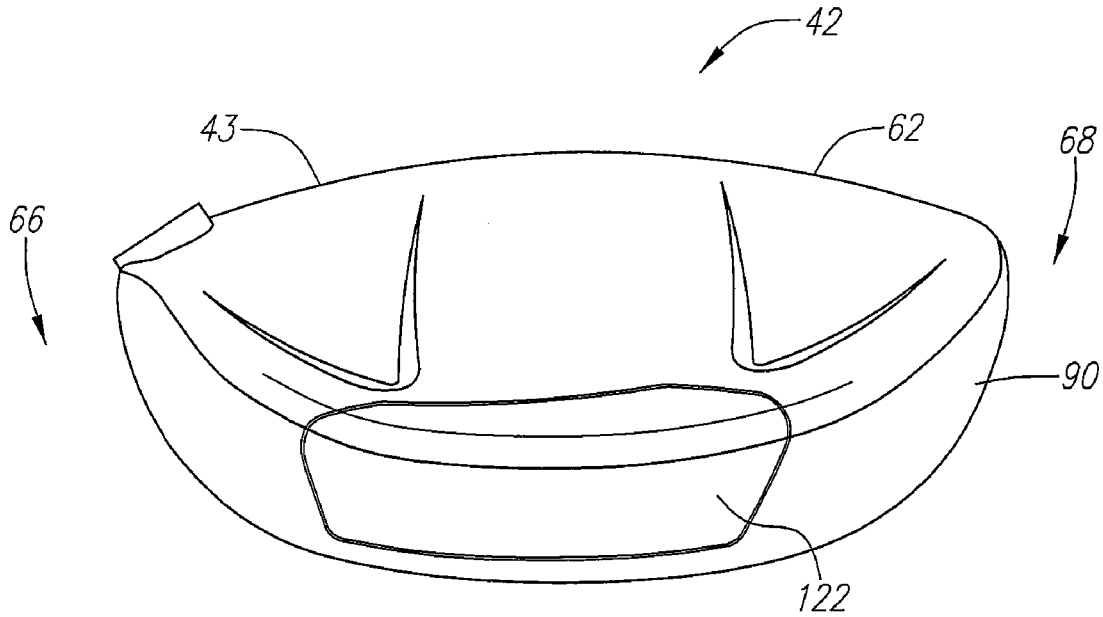
FIG. 4 is a rear view of the golf club head of FIG. 1.

The present invention is generally directed at a golf club head that has a relatively high moment of inertia Izz about the center of gravity of the golf club head. A general embodiment of the club head is illustrated in FIGS. 1-4. Those skilled in the pertinent art will recognize from this disclosure that other embodiments of the golf club head of the present invention are possible without departing from the scope and spirit of the present invention.

As shown in the figures, a golf club head of the present invention is generally designated 42. Preferably, a body 43 of the golf club head has a crown 62, a sole 64, a ribbon 90, and a striking plate 72, all of which preferably define a hollow interior. The golf club head 42 has a heel end 66, a toe end 68 and an aft end 70.

The golf club head 42, when designed as a driver, preferably has a volume from 200 cubic centimeters to 600 cubic centimeters, more preferably from 300 cubic centimeters to 500 cubic centimeters, and most preferably from 420 cubic centimeters to 475 cubic centimeters, even more preferably from 450 cubic centimeters to 475 cubic centimeters, with a most preferred volume of 460 cubic centimeters. The volume of the golf club head 42 will also vary between fairway woods (preferably ranging from 3-woods to eleven woods) with smaller volumes than drivers.

The golf club head 42, when designed as a driver, preferably has a mass no more than 225 grams, and most preferably a mass of 180 to 215 grams. When the golf club head 42 is designed as a fairway wood, the golf club head preferably has a mass of 135 grams to 200 grams, and preferably from 140 grams to 165 grams.

Not shown engaging the club head 42 is a shaft 48 that has a grip 50 at a butt end 52 of the shaft 48 and is inserted into a hosel 54 of the club head 42 at a tip end 56 of the shaft 48.

The golf club head 42 preferably has a distance, "L", from a furthest forward extent of the striking plate 72 to a furthest rearward extent of the golf club head 42 that preferably ranges from 2.00 to 5.00 inches, more preferably from 3.0 to 5.0 inches, and most preferably from 4.0 to 5.0 inches.

Figure 5:
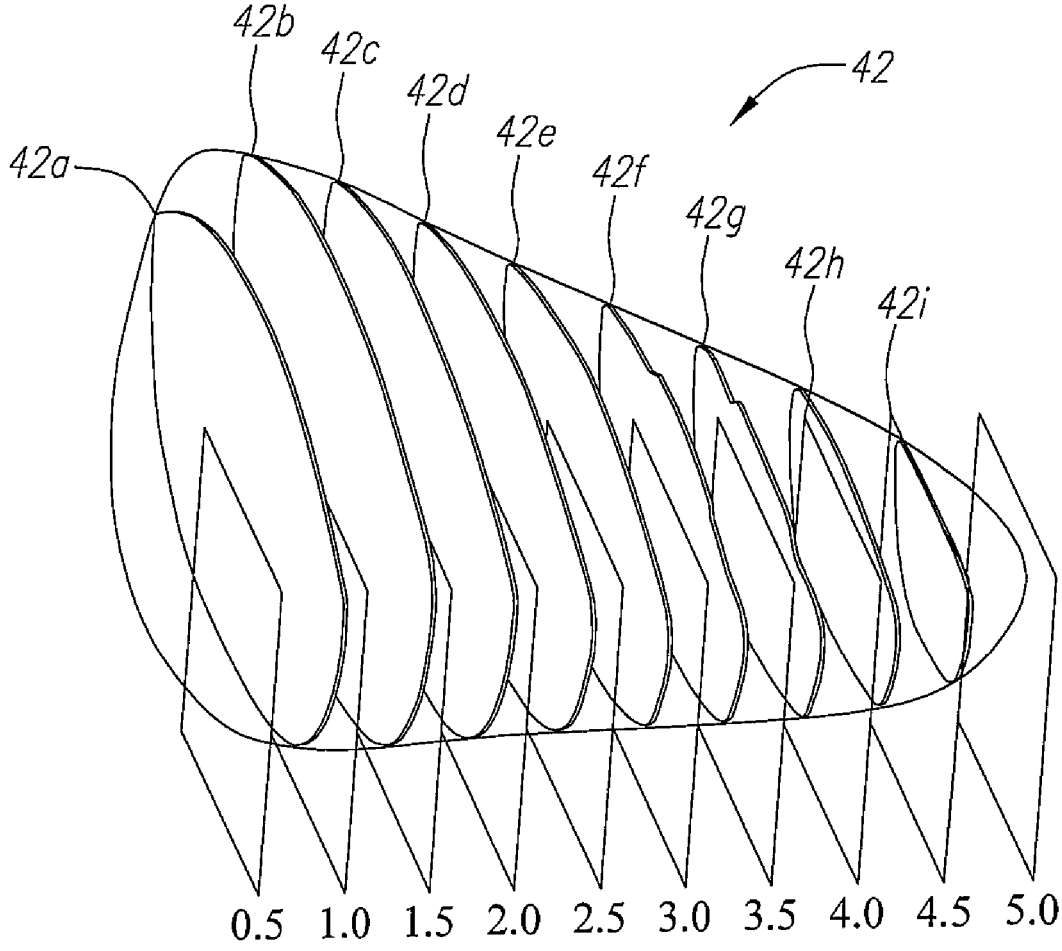
FIG. 5 is a top perspective view of a representation of a golf club head of the present invention partitioned into 0.5 inch portions as shown by the designated planes and with cuts (slices) designated 42*a*-42*i* illustrating the height of the particular portion of the golf club head within a 0.5 portion.
Figure 7:
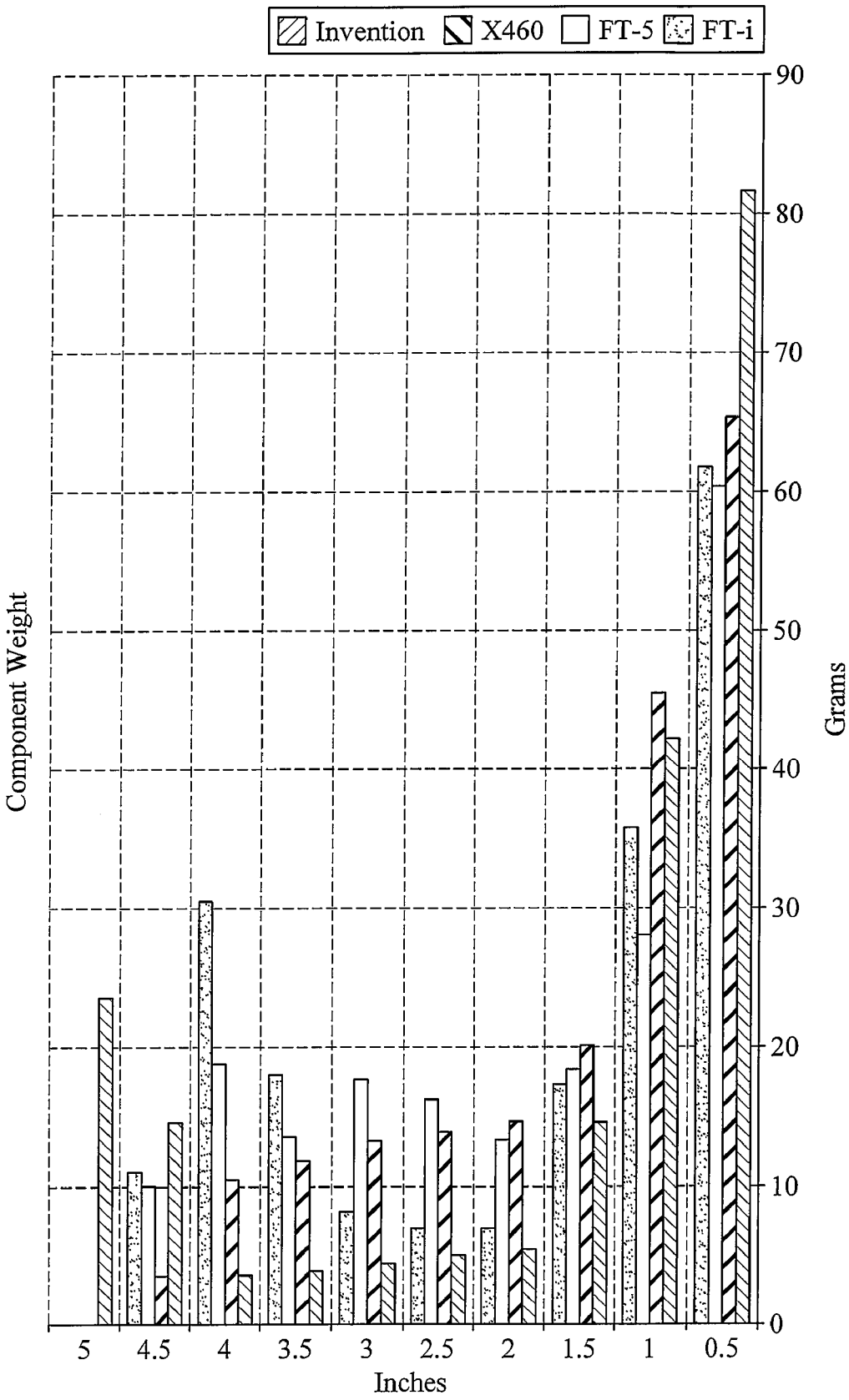
FIG. 7 is a graph of the mass values of the table of FIG. 6.

As shown in FIGS. 5-7, the golf club head 42 of the present invention has a greater mass distribution at the extreme front and rear of the club head 42 than the prior art club heads. This extreme weighting increases the moment of inertia Iyy of the golf club head 42.

As shown in FIG. 5, an image of a golf club head 42 partitioned into 0.5 inch sections allows for a better description of the extreme weighting. Each plane (designated 0.5, 1.0, 1.5, 2.0, 2.5, 3.0, 3.5, 4.0, 4.5 and 5.0) represents a 0.5 inch section of the golf club head 42. The first plane 0.5 is 0.5 inch from the exterior surface of the striking plate 72. The next plane 1.0 is 1 inch from the exterior surface of the striking plate 72. The other planes follow a similar spacing. The last plane 5.0 is at the very end of the golf club head 42.

The Table of FIG. 6 illustrates the mass and heel to toe distance of the golf club head of the present invention and three commercially available drivers from Callaway Golf Company, the X460® Driver, the FT-5® Driver and the FT-i® Driver. The heel-to toe distances are illustrated by cuts 42*a*-42*i*. The mass values correspond to the portion of the golf club head within the 0.5 inch sections. More specifically, the 81.5547 grams of first section includes the volume of the golf club head 42 from the exterior surface of the striking plate 72 rearward a distance of 0.5 inch. The second section, 1.0 section, includes the volume of the golf club head 42 from the plane designated 0.5 to the plane 1.0, and the mass is 42 grams, which combined with the mass of the first 0.5 section is over 123 grams or greater than 60% of the total mass of the golf club head 42. The golf club head 42 of the present invention has the greatest amount of mass in the first and second 0.5 inch sections of any of the golf club heads of the table of FIG. 6, either in an absolute value or as a percentage of the total mass of the golf club head. Further, the golf club head 42 of the present invention has the greatest amount of mass in the last 0.5 inch section of any of the golf club heads of the table of FIG. 6, either in an absolute value or as a percentage of the total mass of the golf club head. Of note, the golf club head 42 of the present invention is longer than the other golf club heads of the table of FIG. 6, however, the mass of the last 0.5 inch section of the golf club head 42 (5.0 section having a mass of 23.8583 grams) is greater than the last 0.5 inch section of the other golf club heads (4.5 section with masses of 3.9483 grams, 10.4414 grams and 11.4727 grams respectively) either in an absolute value or as a percentage of the total mass of the golf club head. Also, the golf club head 42 of the present invention has the least amount of mass in the middle 0.5 inch sections of any of the golf club heads of the table of FIG. 6, either in an absolute value or as a percentage of the total mass of the golf club head. For example, between a first section (which extends from the front wall to 1.0 inch from the front wall of the golf club head) and a third section (which begins 4.0 inches from the front wall of a golf club head and extends to the rear wall), a second section of the golf club head of the present invention has less than 20% of the mass of the golf club head 42. The golf club head 42 only has a mass of approximately 38 grams (less than 20% of the mass of the golf club head) while the other golf club heads have masses of approximately 74.5 grams (X460® Driver with 37% of the mass of the golf club head), approximately 79.8 grams (FT-5® Driver with 40% of the mass of the golf club head) and approximately 58.3 grams (FT-i® Driver with 29% of the mass of the golf club head). Thus, the golf club head 42 of the present invention optimizes mass placement in a high volume golf club head to achieve a greater moment of inertia. Thus, the golf club head 42 of the present invention has a combined moments of inertia Iyy and Izz which is greater than 9000 grams-centimeters squared. The FT-i® Driver from Callaway Golf Company has a combined moments of inertia Iyy and Izz of approximately 8000 grams-centimeters squared. The FT-5® Driver from Callaway Golf Company has a combined moments of inertia Iyy and Izz of approximately 7700 grams-centimeters squared. The X460® Driver from Callaway Golf Company has a combined moments of inertia Iyy and Izz of less than 6000 grams-centimeters squared.

Figure 8:
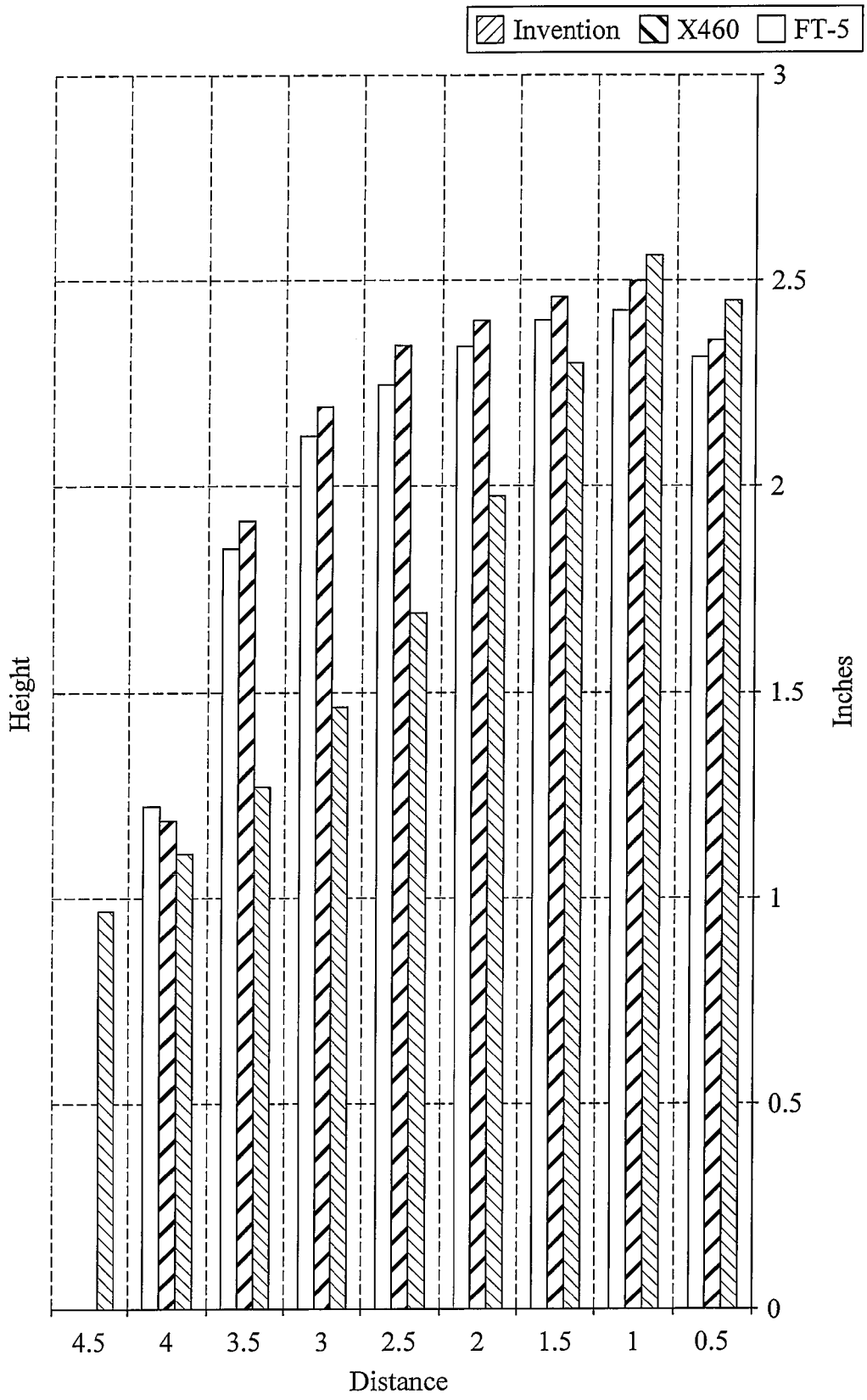
FIG. 8 is a graph of the distance values of the table of FIG. 6.

As illustrated in FIG. 8, the golf club head 42 of the present invention has a more extreme height change than similar large volume golf club heads of the prior art. Referring to the vertical planes of FIG. 5, at a distance of within 1.0 inch from the striking plate 72, the golf club head 42 has a height of at least 2.5 inches, although there are other heights within 1.0 inch of the striking plate that are lower than 2.5 inches. At the rear of the golf cub head 42, 4.5 inches from the striking plate 72 and rearward, the golf club head has a height less than 1.0 inch. Thus, there is a decrease in height of at least 1.5 inches from the front of the golf club head 42 to the rear of the golf club head 42. The height difference allows for the golf club head 42 to have a large hitting surface (face area) in a limited volume (450 cc to 475 cc) golf club head but increase the length (4.0 inches to 5.0 inches) of the golf club head 42 to increase the moment of inertia of the golf club head (Iyy greater than 4000 g-cm$^2$).

The shape of the golf club head 42 of the present invention is more triangular than the other golf club heads of the Table of FIG. 6, which is illustrated by the narrowing width measurements of the cuts 42*a*-42*i*.

Figure 9:
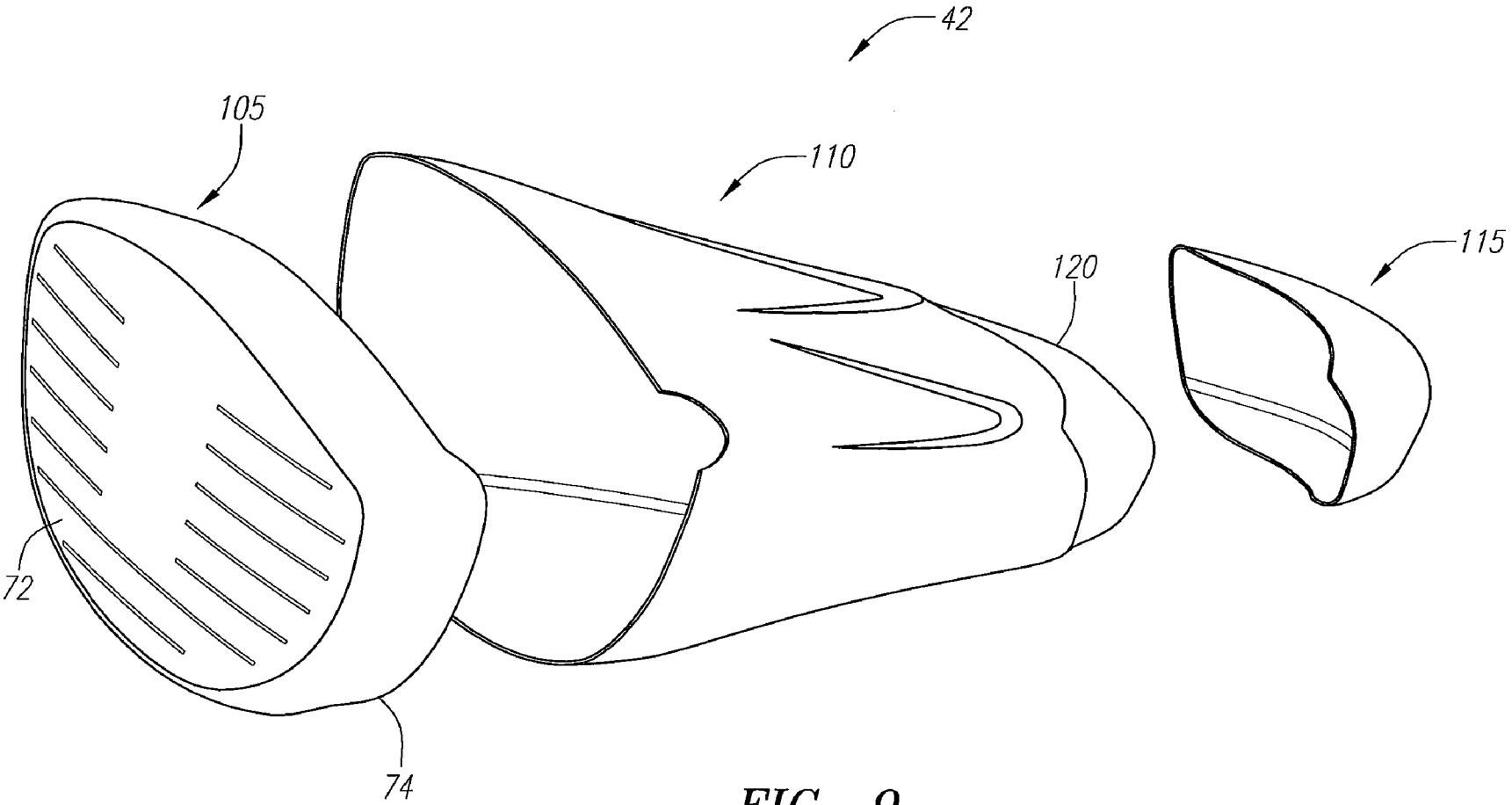
FIG. 9 is an exploded view of a golf club head of the present invention.

In a preferred embodiment, the club head 42 is generally composed of two components, a face component, and an aft-body. As shown in FIG. 9, a preferred embodiment of the golf club head 42 preferably includes a face component 105, an aft body 110 and a weight member 115. The weight member 115 is attached to a rear inlaid portion 120 of the aft-body 110. The face component 105 preferably includes a striking plate portion 72 and a return portion 74.

The face component 105 is generally composed of a single piece of metal, and is preferably composed of a forged metal material. More preferably, the forged metal material is a forged titanium material. Such titanium materials include pure titanium and titanium alloys such as 6-4 titanium alloy, SP-700 titanium alloy (available from Nippon Steel of Tokyo, Japan), DAT 55G titanium alloy available from Diado Steel of Tokyo, Japan, Ti 10-2-3 Beta-C titanium alloy available from RTI International Metals of Ohio, and the like. Other metals for the face component 105 include stainless steel, other high strength steel alloy metals and amorphous metals. Alternatively, the face component 105 is manufactured through casting, forming, machining, powdered metal forming, metal-injection-molding, electro chemical milling, and the like.

The face component 105 generally includes the striking plate or front wall 72 and a return portion 74 extending laterally inward from a perimeter of the striking plate 72. The striking plate 72 typically has a plurality of scorelines thereon. The striking plate 72 preferably has a thickness ranging from 0.010 inch to 0.250 inch, and the return portion 74 preferably has a thickness ranging from 0.010 inch to 0.250 inch. The return portion 74 preferably extends a distance ranging from 0.25 inch to 1.5 inches from the perimeter of the striking plate portion.

In a preferred embodiment, the return portion 74 generally includes an upper lateral section, a lower lateral section, a heel lateral section and a toe lateral section. Thus, the return portion 74 preferably encircles the striking plate 72 a full 360 degrees. However, those skilled in the pertinent art will recognize that the return portion 74 may only encompass a partial section of the striking plate 72, such as 270 degrees or 180 degrees, and may also be discontinuous.

The aft-body 110 is preferably composed of a non-metal material, preferably a composite material such as continuous fiber pre-preg material (including thermosetting materials or a thermoplastic materials for the resin). Other materials for the aft-body 110 include other thermosetting materials or other thermoplastic materials such as injectable plastics. Alternatively, the aft-body 110 is composed of low-density metal materials, such as magnesium or aluminum. Exemplary magnesium alloys are available from Phillips Plastics Corporation under the brands AZ-91-D (nominal composition of magnesium with aluminum, zinc and manganese), AM-60-B (nominal composition of magnesium with aluminum and manganese) and AM-50-A (nominal composition of magnesium with aluminum and manganese). The aft-body is preferably manufactured through metal-injection-molding. Alternatively, the aft-body is manufactured through casting, forming, machining, powdered metal forming, electro chemical milling, and the like.

The aft-body 110 is preferably manufactured through bladder-molding, resin transfer molding, resin infusion, injection molding, compression molding, or a similar process. In a preferred process, the face component, with an adhesive on the interior surface of the return portion 74, is placed within a mold with a preform of the aft-body 110 for bladder molding. Such adhesives include thermosetting adhesives in a liquid or a film medium. A preferred adhesive is a two part liquid epoxy sold by 3M of Minneapolis Minn. under the brand names DP420NS and DP460NS. Other alternative adhesives include modified acrylic liquid adhesives such as DP 810 NS, also sold by the 3M company. Alternatively, foam tapes such as Hysol Synspan may be utilized with the present invention. A bladder is placed within the hollow interior of the preform and face component 60, and is pressurized within the mold, which is also subject to heating. The co-molding process secures the aft-body 110 to the face component 105. Alternatively, the aft-body 110 is bonded to the face component using an adhesive, or mechanically secured to the return portion 74.

In a preferred embodiment, the aft-body 110 is composed of a plurality of plies of pre-preg, typically six or seven plies, such as disclosed in U.S. Pat. No. 6,248,025, entitled Composite Golf Head And Method Of Manufacturing, which is hereby incorporated by reference in its entirety.

The hosel is preferably at least partially disposed within the hollow interior of the club head 42, and is preferably located as a part of the face component 105. The hosel is preferably composed of a similar material to the face component 105, and is preferably secured to the face component 105 through welding or the like. Alternatively, the hosel may be formed with the formation of the face component 105.

In a preferred embodiment, a weight member 122 is preferably positioned on the rear end 70 of the body 43 to increase the moment of inertia of the club head 42, to influence the center of gravity, and/or influence other inherent properties of the golf club head 42. The weight member 122 is preferably composed of tungsten loaded film, tungsten doped polymers, or similar weighting mechanisms such as described in U.S. Pat. No. 6,386,990, entitled A Composite Golf Club Head With An Integral Weight Strip, and hereby incorporated by reference in its entirety. Those skilled in the pertinent art will recognize that other high density materials, such as lead-free pewter, may be utilized as an optional weight without departing from the scope and spirit of the present invention.

In a preferred embodiment, the weight member 122 has a mass ranging from 5 grams to 50 grams, more preferably from 10 grams to 30 grams, and most preferably from 15 grams to 25 grams. The weight member 122 is preferably composed of a material that has a density ranging from 5 grams per cubic centimeters to 20 grams per cubic centimeters, more preferably from 7 grams per cubic centimeters to 12 grams per cubic centimeters.

The weight member 122 is preferably composed of a polymer material integrated with a metal material. The metal material is preferably selected from copper, tungsten, steel, aluminum, tin, silver, gold, platinum, or the like. A preferred metal is tungsten due to its high density. The polymer material is a thermoplastic or thermosetting polymer material. A preferred polymer material is polyurethane, epoxy, nylon, polyester, or similar materials. A most preferred polymer material is a thermoplastic polyurethane. A preferred weight member 122 is an injection molded thermoplastic polyurethane integrated with tungsten to have a density of 8.0 grams per cubic centimeters. In an alternative embodiment, the weight member 122 is composed of from 50 to 95 volume percent polyurethane and from 50 to 5 volume percent tungsten. Also, in an alternative embodiment, the weight member 122 is composed of from 10 to 25 weight percent polyurethane and from 90 to 75 weight percent tungsten. The placement of the weight member 122 allows for the moment of inertia of the golf club head 42 to be optimized.

The face component 105 has a striking plate 72 with varying thickness. In a preferred embodiment, the striking plate 72 has a varying thickness such as described in U.S. Pat. No. 6,398,666, for a Golf Club Striking Plate With Variable Thickness, which pertinent parts are hereby incorporated by reference. Other alternative embodiments of the thickness of the striking plate 72 are disclosed in U.S. Pat. No. 6,471,603, for a Contoured Golf Club Face and U.S. Pat. No. 6,368,234, for a Golf Club Striking Plate Having Elliptical Regions Of Thickness, which are both owned by Callaway Golf Company and which pertinent parts are hereby incorporated by reference. Alternatively, the striking plate 72 has a uniform thickness.

As mentioned previously, the face component 105 is preferably forged from a rod of metal material. One preferred forging process for manufacturing the face component is set forth in U.S. Pat. No. 6,440,011, entitled Method For Processing A Striking Plate For A Golf Club Head, and hereby incorporated by reference in its entirety. Alternatively, the face component 105 is cast from molten metal in a method such as the well-known lost-wax casting method. The metal for forging or casting is preferably titanium or a titanium alloy such as 6-4 titanium alloy, alpha-beta titanium alloy or beta titanium alloy for forging, and 6-4 titanium for casting.

Additional methods for manufacturing the face component 105 include forming the face component 105 from a flat sheet of metal, super-plastic forming the face component from a flat sheet of metal, machining the face component 105 from a solid block of metal, electrochemical milling the face from a forged pre-form, and like manufacturing methods. Yet further methods include diffusion bonding titanium sheets to yield a variable face thickness face and then superplastic forming.

Alternatively, the face component 105 is composed of an amorphous metal material such as disclosed in U.S. Pat. No. 6,471,604, and is hereby incorporated by reference in its entirety.

In an alternative embodiment of the golf club head 42, the body 43 has a front wall with an opening in which a striking plate 72 is preferably disposed within the opening. The body 43 is preferably composed of a non-metal material, preferably a composite material such as a continuous fiber pre-preg material (including thermosetting materials or thermoplastic materials for the resin). Other materials for the body 43 include other thermosetting materials or other thermoplastic materials such as injectable plastics. Further, other materials for the body 43 include magnesium alloys, aluminum alloys, magnesium, aluminum or other low density metals. The body 43 is preferably manufactured through bladder-molding, resin transfer molding, resin infusion, injection molding, compression molding, or a similar process.

The striking plate insert 72 is attached to the body 43 over the opening of the front wall of the body 43. The striking plate insert 72 is preferably composed of a formed metal material. Alternatively the striking plate insert 72 is composed of a machined metal material, a forged metal material, a cast metal material or the like. The striking plate insert 72 preferably is composed of a formed titanium or steel material. A preferred material is steel 4340, which is heat treated and then coated with a titanium nitride. Titanium materials useful for the striking plate insert 40 include pure titanium and titanium alloys such as 6-4 titanium alloy, SP-700 titanium alloy (available from Nippon Steel of Tokyo, Japan), DAT 55G titanium alloy available from Diado Steel of Tokyo, Japan, Ti 10-2-3 Beta-C titanium alloy available from RTI International Metals of Ohio, and the like. Other metals for the striking plate insert 40 include other high strength steel alloy metals and amorphous metals. Such steel materials include 17-4PH, Custom 450, 455, 465 and 465+ stainless steels, AERMET 100 and AERMET 310 alloy steels, all available from Carpenter Specialty Alloys, of Pennsylvania, and C35 maraging steels available from Allvac of North Carolina. Such amorphous metals include beryllium based alloys such as disclosed in U.S. Pat. No. 5,288,344, which pertinent parts are hereby incorporated by reference, quinary metallic glass alloys such as disclosed in U.S. Pat. No. 5,735,975, which pertinent parts are hereby incorporated by reference, and ternary alloys as disclosed in Calculations of Amorphous-Forming Composition Range For Ternary Alloy Systems And Analyses Of Stabilization Of Amorphous Phase And Amorphous-Forming Ability, Takeuchi and Inoue, Materials Transactions, Vol. 42, No. 7, p 1435-1444 (2001), which pertinent parts are hereby incorporated by reference.

The striking plate 72 is preferably co-molded with a body 43 or press-fifted into the opening subsequent to fabrication of the body 43. In another attachment process, the body 43 is first bladder molded and then the striking plate 72 is bonded to a recessed portion of the front wall using an adhesive. The adhesive is placed on the exterior surface of the recessed portion. Such adhesives include thermosetting adhesives in a liquid or a film medium. A preferred adhesive is a two part liquid epoxy sold by 3M of Minneapolis Minn. under the brand names DP420NS and DP460NS. Other alternative adhesives include modified acrylic liquid adhesives such as DP810NS, also sold by the 3M company. Alternatively, foam tapes such as Hysol Synspan may be utilized with the present invention.

Yet in another embodiment of the golf club head 42, the body 43 is preferably composed of a metal material such as titanium, titanium alloy, or the like, and is most preferably composed of a cast titanium alloy material.

The body 43 is preferably cast from molten metal in a method such as the well-known lost-wax casting method. The metal for casting is preferably titanium or a titanium alloy such as 6-4 titanium alloy, alpha-beta titanium alloy or beta titanium alloy for forging, and 6-4 titanium for casting. Alternatively, the body 43 is composed of 17-4 steel alloy. Additional methods for manufacturing the body 43 include forming the body 43 from a flat sheet of metal, super-plastic forming the body 43 from a flat sheet of metal, machining the body 43 from a solid block of metal, electrochemical milling the body from a forged pre-form, casting the body using centrifugal casting, casting the body using levitation casting, and like manufacturing methods.

The golf club head 42 of this embodiment optionally has a front wall with an opening for placement of a striking plate 72 such as disclosed in U.S. Pat. No. 6,902,497 for A Golf Club Head With A Face Insert. The striking plate 72 preferably is composed of a formed titanium alloy material. Such titanium materials include titanium alloys such as 6-22-22 titanium alloy and Ti 10-2-3 alloy, Beta-C titanium alloy, all available from RTI International Metals of Ohio, SP-700 titanium alloy (available from Nippon Steel of Tokyo, Japan), DAT 55G titanium alloy available from Diado Steel of Tokyo, Japan, and like materials. The preferred material for the striking plate insert 72' is a heat treated 6-22-22 titanium alloy which is a titanium alloy composed by weight of titanium, 6% aluminum, 2% tin, 2% chromium, 2% molybdenum, 2% zirconium and 0.23% silicon. The titanium alloy will have an alpha phase in excess of 40% of the overall microstructure.

In yet another embodiment for the golf club head 42, the golf club head has a construction with a crown composed of plies of pre-preg material such as disclosed in U.S. Pat. No. 6,575,845, for a Multiple Material Golf Club Head, which pertinent parts are hereby incorporated by reference.

In yet another embodiment, the golf club head 42 has a shape as disclosed, and a construction with a body composed of plies of pre-preg material such as disclosed in U.S. Pat. No. 6,607,452, for a High Moment Of Inertia Composite Golf Club Head, which pertinent parts are hereby incorporated by reference.

In a preferred embodiment, the golf club head 42 has a high coefficient of restitution thereby enabling for greater distance of a golf ball hit with the golf club. The coefficient of restitution (also referred to herein as "COR") is determined by the following equation:

$$e = \frac{v_2 - v_1}{U_1 - U_2}$$

wherein $U_1$ is the club head velocity prior to impact; $U_2$ is the golf ball velocity prior to impact which is zero; $v_1$ is the club head velocity just after separation of the golf ball from the face of the club head; $v_2$ is the golf ball velocity just after separation of the golf ball from the face of the club head; and e is the coefficient of restitution between the golf ball and the club face.

The values of e are limited between zero and 1.0 for systems with no energy addition. The coefficient of restitution, e, for a material such as a soft clay or putty would be near zero, while for a perfectly elastic material, where no energy is lost as a result of deformation, the value of e would be 1.0. The present invention provides a club head having a coefficient of restitution ranging from 0.81 to 0.94, as measured under conventional test conditions.

The coefficient of restitution of the club head 42 under standard USGA test conditions with a given ball ranges from approximately 0.81 to 0.94, preferably ranges from 0.82 to 0.88 and is most preferably 0.83.

Additionally, the striking plate portion 72 of the face component 60 has a more rectangular face providing a greater aspect ratio. The aspect ratio as used herein is defined as the width, "W", of the face divided by the height, "H", of the face. In one preferred embodiment, the width W is 100 millimeters and the height H is 56 millimeters giving an aspect ratio of 1.8. The striking plate portion 72 of the present invention preferably has an aspect ratio that is greater than 1.8 for a club head having a volume greater than 420 cubic centimeters.

The face area of the striking plate portion 72 preferably ranges from 5.00 square inches to 10.0 square inches, more preferably from 7.0 square inches to 10.0 square inches, and most preferably from 8.0 square inches to 10.0 square inches.

The axes of inertia are designated X, Y and Z. The X-axis extends from the striking plate portion 72 through the center of gravity, CG, and to the rear of the golf club head 42. The Y-axis extends from the toe end 68 of the golf club head 42 through the center of gravity, CG, and to the heel end 66 of the golf club head 42. The Z-axis extends from the crown portion 62 through the center of gravity, CG, and through the sole portion 64.

As defined in Golf Club Design, Fitting, Alteration & Repair, $4^{th}$ Edition, by Ralph Maltby, the center of gravity, or center of mass, of the golf club head is a point inside of the club head determined by the vertical intersection of two or more points where the club head balances when suspended. A more thorough explanation of this definition of the center of gravity is provided in Golf Club Design, Fitting, Alteration & Repair.

The center of gravity and the moment of inertia of a golf club head 42 are preferably measured using a test frame ($X^T$, $Y^T$, $Z^T$), and then transformed to a head frame ($X^H$, $Y^H$, $Z^H$). The center of gravity of a golf club head may be obtained using a center of gravity table having two weight scales thereon, as disclosed in U.S. Pat. No. 6,607,452, entitled High Moment Of Inertia Composite Golf Club, and hereby incorporated by reference in its entirety. If a shaft is present, it is removed and replaced with a hosel cube that has a multitude of faces normal to the axes of the golf club head. Given the weight of the golf club head, the scales allow one to determine the weight distribution of the golf club head when the golf club head is placed on both scales simultaneously and weighed along a particular direction, the X, Y or Z direction. Those skilled in the pertinent art will recognize other methods to determine the center of gravity and moments of inertia of a golf club head.

In general, the moment of inertia, Izz, about the Z axis for the golf club head 42 of the present invention will range from 4500 g-cm$^2$ to 6000 g-cm$^2$, preferably from 5000 g-cm$^2$ to 6000 g-cm$^2$, and most preferably greater than 5000 g-cm$^2$. The moment of inertia, Iyy, about the Y axis for the golf club head 42 of the present invention will range from 2000 g-cm$^2$ to 5000 g-cm$^2$, preferably from 2500 g-cm$^2$ to 4500 g-cm$^2$, and most preferably greater than 4000 g-cm$^2$. The moment of inertia, Ixx, about the X axis for the golf club head 42 of the present invention will range from 2000 g-cm$^2$ *to* 4000 g-cm$^2$, preferably from 2500 g-cm$^2$ to 3750 g-cm$^2$, and most preferably from 3000 g-cm$^2$ to 3500 g-cm$^2$.

In general, the golf club head 42 has products of inertia such as disclosed in U.S. Pat. No. 6,425,832, and is hereby incorporated by reference in its entirety. Preferably, each of the products of inertia, Ixy, Ixz and Iyz, of the golf club head 42 have an absolute value less than 100 grams-centimeter squared. Alternatively, at least two of the products of inertia, Ixy, lxz or lyz, of the golf club head 42 have an absolute value less than 100 grams-centimeter squared.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention the following:

1. A golf club head comprising:

a face component comprising a striking plate portion and a return portion extending rearward from the striking plate portion, the face component composed of a metal material and having a mass ranging from 100 grams to 150 grams;

an aft-body attached to the return portion of the face component, the aft-body composed of a non-metal material, the aft-body having a mass ranging from 20 grams to 60 grams, the aft-body having a rearward inlaid portion; and a weight member attached to the rearward inlaid portion of the aft-body, the weight member composed of material having a density greater than the density of the metal material of the face component, the weight member having a mass ranging from 20 grams to 60 grams;

wherein the golf club head has a volume ranging from 450 cubic centimeters to 475 cubic centimeters;

wherein the golf club head has a mass ranging from 180 grams to 225 grams;

wherein the golf club head has a length as measured from the forwardmost extent of the front wall to a rearward most extent of the rear wall ranging from 4.0 inches to 5.0 inches;

wherein the golf club head has a moment of inertia, Iyy, about the center of gravity of the golf club head greater than 4000 grams-centimeters squared;

wherein the golf club head is partitioned by a plurality of vertical planes into a first section, a second section and a third section, the first section extending from the front wall to a first vertical plane located 1.0 inch rearward of the front wall of the golf club head, the third section extending from a second vertical plane located 4.5 inches rearward of the front wall of the golf club head to the rear wall, and the second section positioned between the first section and the third section, wherein the first section has a height from sole to crown of at least 2.5 inches, wherein the third section has a height from sole to crown of less than 1.0 inch, and wherein the second section has a height from sole to crown that is less than the height of the first section and greater than the height of the third section.

* * * * *